US005966822A

United States Patent [19]

Coffin et al.

[11] Patent Number: 5,966,822

[45] Date of Patent: Oct. 19, 1999

[54] HOLDER FOR A WET SHAVER

[75] Inventors: David Coffin, Norwich, United Kingdom; David Stanley Fay, Solingen, Germany

[73] Assignee: Warner-Lambert Company, Morris Plains, N.J.

[21] Appl. No.: 08/195,969

[22] Filed: Feb. 10, 1994

[30] Foreign Application Priority Data

Feb. 10, 1993 [DE] Germany ..... 93 01 836 U

[51] Int. Cl.[6] ..... B26B 19/38

[52] U.S. Cl. ..... 30/541; 30/298.4

[58] Field of Search ..... 30/90, 34.05, 298.4, 30/541, 537; D28/45–48, 52–54, 73; D9/342; D6/526; 206/208, 349; 132/289; 211/70.6, 70.7

[56] References Cited

U.S. PATENT DOCUMENTS

D. 305,074 12/1989 Mockovak ..... D28/53
3,352,630 11/1967 Fischer et al. .
4,339,876 7/1982 Davis .
5,095,924 3/1992 Stanfield .
5,228,580 7/1993 Grange ..... D6/526

FOREIGN PATENT DOCUMENTS 2639522 11/1988 France .
8808113 10/1988 Germany .
9014878 4/1992 Germany .
2218368 11/1989 United Kingdom .

*Primary Examiner*—Douglas D. Watts
*Attorney, Agent, or Firm*—Robert W. Becker & Associates

[57] ABSTRACT

A holder for a wet shaver has a base having a holding device for the wet shaver. The holding device has a recess with a rim and also has an upwardly extending support for the wet shaver that is connected to the rim of the recess. The recess is shaped complementary to the free end of the wet shaver handle.

24 Claims, 2 Drawing Sheets

HOLDER FOR A WET SHAVER

BACKGROUND OF THE INVENTION

The present invention relates to a holder for a wet shaver with a base having a means for supporting the wet shaver.

Wet shavers or razors are known in the art. In general, the forward end of the handle is provided with a razor head with a single or double razor blade. In a special embodiment of such wet shavers, so-called razor blade units are used. These razor blade units are separate components in which a single or double razor blade is fixedly embedded within a plastic body. These razor blade units are connected in a releasable and exchangable manner at the razor head of the wet shaver with a corresponding fastening mechanism. For a simple storage of such razor blade units it is known to arrange them in a dispenser.

In general, it is disadvantageous that conventional wet shavers, when not in use, must be placed on a surface, whereby due to the sharp razor blades a potentially hazardous situation with respect to injuries results.

For a safe storage of a wet shaver it is known from German Gebrauchsmuster 90 14 878 to provide a holder for the combined storage of a wet shaver and a dispenser for razor blade units. The holder has a base portion that is provided with a support for suspending the wet shaver, whereby a receiving device in the form of a slot-shaped recess for receiving a box-shaped dispenser is provided at the base.

This known holder for a wet shaver has the disadvantage that it is comprised of two separate parts. The support for suspending the wet shaver must be mounted on the base portion. Due to the two-part embodiment and the necessary assembly, the manufacture of the known wet shaver holder is relatively expensive.

It is furthermore disadvantageous that for storing the wet shaver it must be suspended from the free ends of the support that are in the form of two lateral, upwardly extending, fork-shaped projections. At the moment of insertion into the free ends the user exerts an additional force at the upper end of the support so that the support overall is destabilized for a short period of time and may fall over. The removal of the wet shaver from the support has also been proven to be impractical.

It is therefore an object of the present invention to provide a holder for a wet shaver which is more economical to produce and which allows for an easier manipulation.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
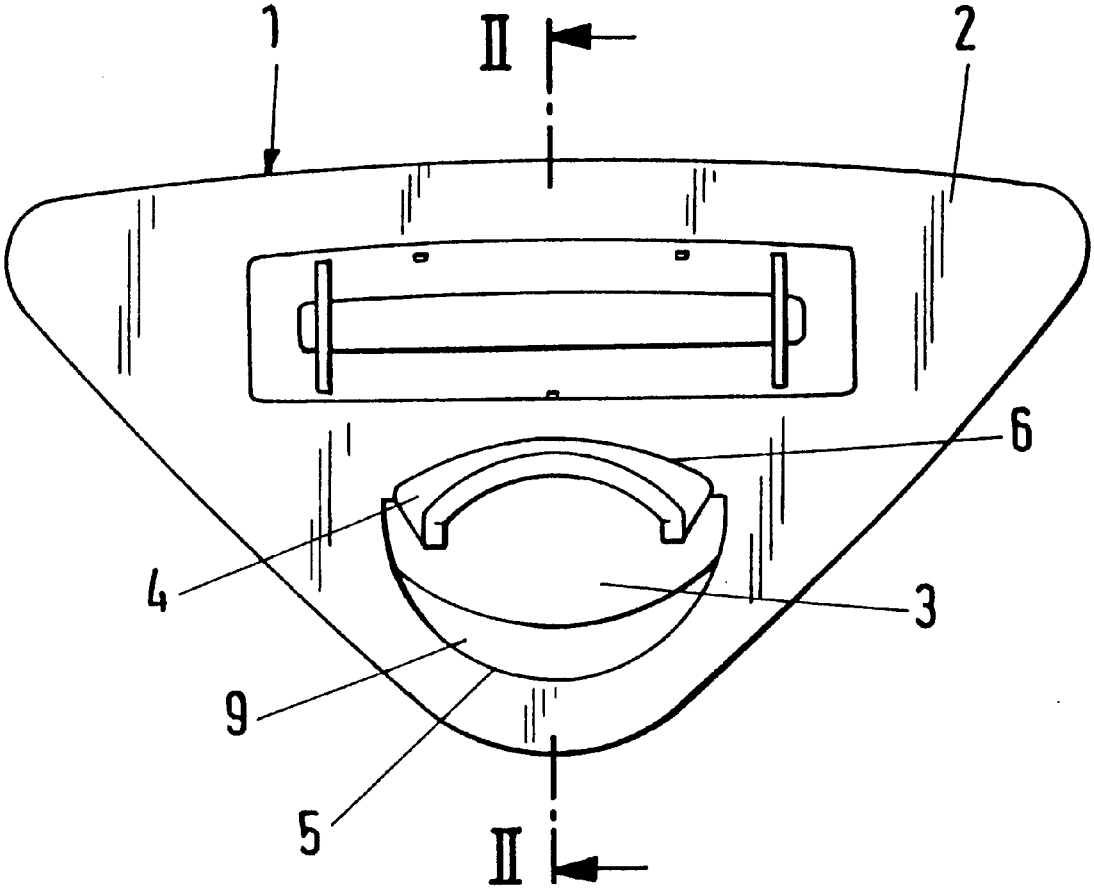
FIG. 1 shows a plan view of the inventive holder.

The holder for a wet shaver according to the present invention is primarily characterized by:

A base having a holding device for the wet shaver;

The holding device comprising a recess with a rim; and

The holding device further comprising a means for supporting the wet shaver, the means for supporting connected to the rim of the recess.

Preferably, the means for supporting is an upwardly extending support. Advantageously, the rim of the recess has a substantially semi-circular upper edge and a connecting edge extending between ends of the semi-circular upper edge. Expediently, the connecting edge is curved at a radios greater than the radius of the semi-circular upper edge.

In a preferred embodiment of the present invention, the shape of the recess is complementary to the shape of the free end of the handle of the wet shaver and the recess in the area of the connecting edge has a substantially vertical surface.

Advantageously, the recess in the area of the semi-circular upper edge has a slanted surface.

Preferably, the support is a plate having a curvature relative to a vertical axis of the plate.

Expediently, the support has an upper edge positioned below a center of gravity of the wet shaver inserted into the recess.

In another embodiment of the present invention, the base has a slot-shaped depression for receiving a box-shaped dispenser for razor blade units.

Advantageously, the base has an underside with legs

Expediently, the holder is a unitary molded plastic part.

Advantageously, the recess is a perforation extending through the base. Expediently, at a lower end of the perforation an enlarged free space is provided.

The present invention is furthermore concerned with the combination of a holder and a wet shaver, primarily characterized by:

A wet shaver;

A holder having a base with a holding device for receiving the wet shaver;

The holding device comprising a recess with a rim; and

The holding device further comprising a means for supporting the wet shaver, the means for supporting connected to the rim of the recess.

Preferably, the means for supporting is an upwardly extending support.

Expediently, the rim of the recess has a substantially semi-circular upper edge and a connecting edge extending between ends of the upper edge.

Preferably, the connecting edge is curved at a radius greater than a radius of the semi-circular upper edge.

According to a preferred embodiment of the present invention, the wet shaver has a handle with a free end, the recess has a shape that is complementary to the shape of the free end of the handle of the wet shaver, and the recess in the area of the connecting edge has a substantially vertical surface.

Advantageously, the recess in the area of the semi-circular upper edge has a slanted surface.

Advantageously, the support is a plate having a curvature relative to a vertical axis of the plate.

Expediently, the support has an upper edge positioned below a center of gravity of the wet shaver when inserted into the recess.

In a preferred embodiment of the present invention, the base has a slot-shaped depression for receiving a box-shaped dispenser for razor blade units.

In another embodiment of the present invention, the base has an underside with legs.

Expediently, the holder is a unitary molded plastic part.

Preferably, the recess is a perforation extending through the base. Expediently, at the lower end of the perforation an enlarged free space is provided.

According to the present invention, a holder for a wet shaver has a base that is provided with a holding device for the wet shaver. The holding device is comprised of a recess and a means for supporting connected to the rim of the recess.

Advantageously, the means for supporting is comprised of a support that is arranged at the rim of the recess and that extends upwardly.

According to one inventive embodiment, the wet shaver can be inserted with the rearward end of its handle vertically into the recess of the holder and can be secured by the support against toppling. On the one hand, the inventive holder can be manufactured as a unitary part from a plastic material so that the production is more economical, and, on the other hand, the handling of the device by the user is simplified. Also, no additional forces are exerted by the user so that the holder, in general, is more stable.

In another advantageous embodiment of the invention, the recess has a substantially semi-circular upper edge with a connecting edge, a so-called diameter edge that connects the diameter of the semi-circle. The support is arranged at the connecting edge (diameter edge). Advantageously, the diameter edge should have a greater radius than the remaining semi-circular upper edge.

It is furthermore suggested that the recess be embodied complementary to the shape of the free end of the handle of the wet shaver whereby in the area of the diameter edge the recess has a substantially vertically extending surface. Accordingly, a portion of the underside of the handle can be inserted into the recess in a form-fitting manner so as to be supported against displacement at the vertical straight surface.

It is furthermore advantageously suggested that the support is in the form of a curved support wall that is curved or bent about its vertical axis. The handle portion of the handle of the wet shaver that rests at the support wall is thus supported at a plurality of contact points. This measure further increases the stability of the wet shaver within the holder. This is furthermore improved by another suggestion of the present invention according to which the support ends at a level which is below the center of gravity of the wet shaver inserted into the holder.

Due to this measure, the wet shaver has a tendency to rotate about its center of gravity and find support at the upper edge of the support wall (plate). On the other hand, the wet shaver rests in a form-locking manner within the recess of the base and simultaneously finds support at the lower forward edge of the vertical surface of the recess. This three-point support provides for a stable securing of the wet shaver within the holder.

In another preferred embodiment of the present invention, the recess in the area of the semi-circular upper edge is slanted so that the insertion and removal of the wet shaver is improved.

According to another advantageous embodiment invention, the recess is in the form of a perforation within the base. This prevents collection of liquid or other residues within the holder. Furthermore, residues within the wet shaver itself can drain. This is further improved by providing an enlarged free space (opening) at the lower end of the perforation. The enlarged free space improves also the operational safety of the holder because the removal of a wet shaver from the holder is facilitated with respect to a grip that might otherwise adhere to the holder due to moisture collected at the handle.

It is furthermore expedient that the inventive holder has slot-shaped recess or depression for receiving substantially box-shaped razor blade units or dispensers for such units. The usability of the holder, especially in wet areas, is furthermore improved by arranging legs at the underside of the base.

Such holders may be manufactured advantageously as a unitary plastic part by molding.

DESCRIPTION OF PREFERRED EMBODIMENTS

The present invention will now be described in detail, with the aid of several specific embodiments utilizing FIGS. 1 and 2.

According to FIG. 1 the holder 1 is comprised of a base 2 which has a recess 3 for receiving a wet shaver. The wet shaver when inserted is supported at the support 4. The recess 3 has a semi-circular upper edge 5 and a so-called diameter edge 6 (connecting edge) that is curved at a greater radius than the semi-circular upper edge. The support 4 is a support wall (plate) that is curved about its vertical axis. In the area of tie semi-circular upper edge 5 the recess 3 is provided with a slant 9. In the area of the connecting edge 6 the recess has a substantially vertically extending surface 6*a*.

Figure 2:
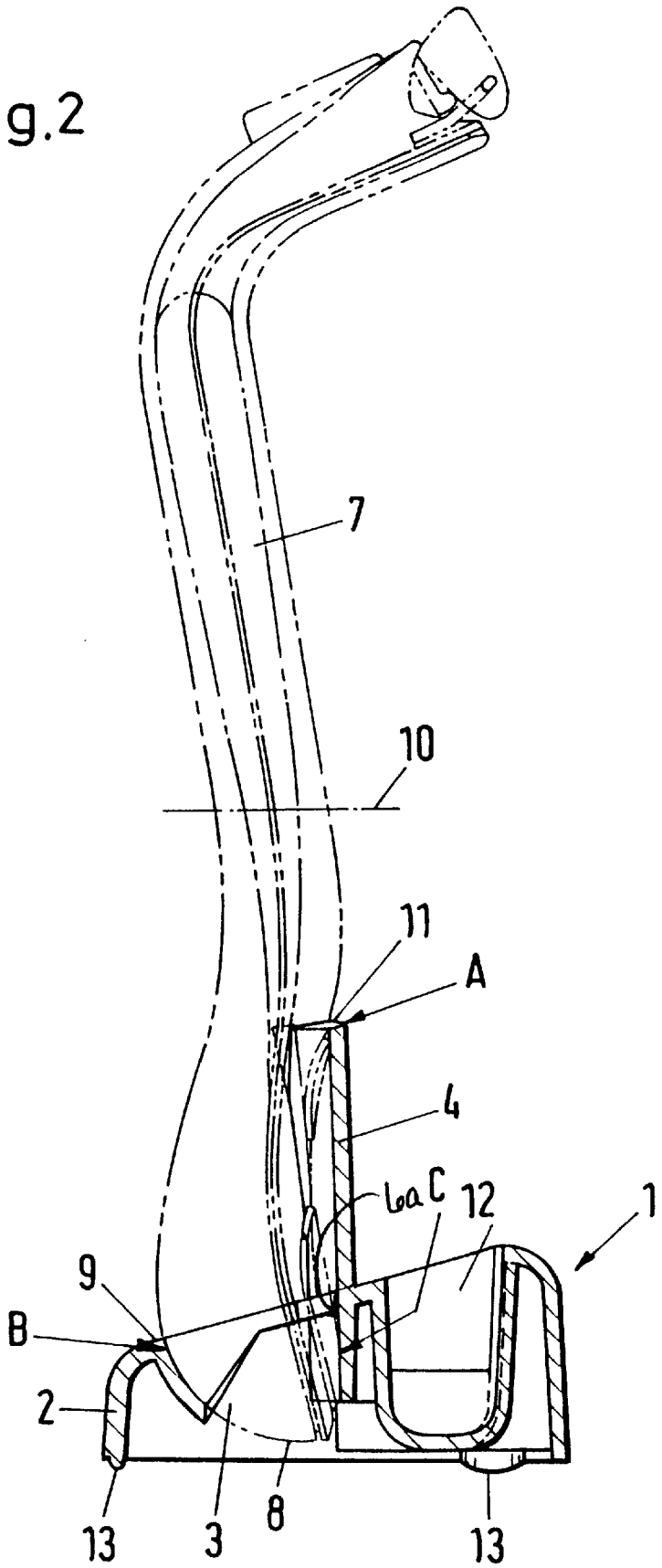
FIG. 2 shows a part-sectional side view along the line II—II of FIG. 1.

As can be seen in FIG. 2, the recess 3 has a contour that corresponds or is complementary to the shape of the free end of the handle 8 of the wet shaver 7. Due to the slant 9 within the area of the semi-circular upper edge 5, the wet shaver 7 can be easily inserted into and removed from the recess.

The support 4 ends at a level 11 which is below the center of gravity 10 of the inserted wet shaver 7.

The wet shaver 7 in the inserted position is thus supported at the points A, B, and C (lower forward edge of surface 6*a*). Due to the fact that the center of gravity 10 is above the upper edge 11 of the support 4, the wet shaver has the tendency to rotate about point A whereby it is prevented from rotation due to the form-locking arrangement of the free end of the handle 8 of the wet shaver 7 within the recess 3. In addition, the wet shaver 7 is also supported at point C. A slot-shaped depression 12 in the rearward area of the base 2 serves for receiving a substantially box-shaped dispenser for razor blade units.

At the underside of the base 2 legs 13 are provided. The base 2 and the support 4 together from a unitary part made of plastic material.

The present invention is, of course, in no way restricted to the specific disclosure of the specification and drawings, but also encompasses any modifications within the scope of the appended claims.

What we claim is:

1. A holder for a wet shaver, said holder comprising:

a base having a holding device for the wet shaver;

said holding device comprising a recess with a rim; and said holding device further comprising an upwardly extending support for supporting the wet shaver, said upwardly extending support connected to said rim of said recess, wherein said wet shaver when inserted into said recess leans on said upwardly extending support.

2. A holder according to claim 1, wherein said rim of said recess has a substantially semi-circular upper edge and a connecting edge extending between ends of said semi-circular upper edge.

3. A holder according to claim 2, wherein said connecting edge is curved at a radius greater than a radius of said semi-circular upper edge.

4. A holder according to claim 2, wherein a shape of said recess is complementary to a shape of a free end of a handle of the wet shaver and wherein said recess in the area of said connecting edge has a substantially vertical surface.

5. A holder according to claim 1, wherein said recess in the area of said semi-circular upper edge has a slanted surface.

6. A holder according to claim 1, wherein said support is a plate having a curvature relative to a vertical axis of said plate.

7. A holder according to claim 1, wherein said support has an upper edge positioned below a center of gravity of the wet shaver inserted into said recess.

8. A holder according to claim 1, wherein said base has a slot-shaped depression for receiving a box-shaped dispenser for razor blade units.

9. A holder according to claim 1, wherein said base has an underside with legs.

10. A holder according to claim 1, wherein said holder is a unitary molded plastic part.

11. A holder according to claim 1, wherein said recess is a perforation extending through said base.

12. A holder according to claim 11, wherein at a lower end of said perforation an enlarged free space is provided.

13. A combination of a holder and a wet shaver, said combination comprising:

a wet shaver;

a holder having a base with a holding device for receiving said wet shaver;

said holding device comprising a recess with a rim;

said holding device further comprising an upwardly extending support for supporting the wet shaver, said upwardly extending support connected to said rim of said recess, wherein said wet shaver when inserted into said recess leans on said upwardly extending support.

14. A combination according to claim 13, wherein said rim of said recess has a substantially semi-circular upper edge and a connecting edge extending between ends of said semi-circular upper edge.

15. A combination according to claim 14, wherein said connecting edge is curved at a radius greater than a radius of said semi-circular upper edge.

16. A combination according to claim 14, wherein:

said wet shaver has a handle with a free end;

said recess has a shape that is complementary to a shape of said free end of said handle of said wet shaver; and said recess in the area of said connecting edge has a substantially vertical surface.

17. A combination according to claim 13, wherein said recess in the area of said semi-circular upper edge has a slanted surface.

18. A combination according to claim 13, wherein said support is a plate having a curvature relative to a vertical axis of said plate.

19. A combination according to claim 13, wherein said support has an upper edge positioned below a center of gravity of said wet shaver when inserted into said recess.

20. A combination according to claim 13, wherein said base has a slot-shaped depression for receiving a box-shaped dispenser for razor blade units.

21. A combination according to claim 13, wherein said base has an underside with legs.

22. A combination according to claim 13, wherein said holder is a unitary molded plastic part.

23. A combination according to claim 13, wherein said recess is a perforation extending through said base.

24. A combination according to claim 23, wherein at a lower end of said perforation an enlarged free space is provided.

* * * * *